US009752092B2

(12) United States Patent
Qian

(10) Patent No.: US 9,752,092 B2
(45) Date of Patent: Sep. 5, 2017

(54) LUBRICATING OIL COMPOSITIONS CONTAINING AMIDINE ANTIOXIDANTS

(71) Applicant: Chevron Oronite Company LLC, San Ramon, CA (US)

(72) Inventor: Xuelei Lily Qian, Fremont, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 14 days.

(21) Appl. No.: 14/928,050

(22) Filed: Oct. 30, 2015

(65) Prior Publication Data

US 2017/0121625 A1 May 4, 2017

(51) Int. Cl.

| | |
|---|---|
| ***C10M 133/40*** | (2006.01) |
| ***C10M 133/44*** | (2006.01) |
| *C10N 30/10* | (2006.01) |

(52) U.S. Cl.

CPC ..... *C10M 133/44* (2013.01); *C10M 133/40* (2013.01); *C10M 2215/221* (2013.01); *C10M 2215/223* (2013.01); *C10M 2215/224* (2013.01); *C10N 2030/10* (2013.01); *C10N 2230/10* (2013.01)

(58) Field of Classification Search

CPC ..... C10M 133/44; C10M 2215/223; C10N 2030/10; C10N 2230/10

USPC ..... 508/268, 284, 563

See application file for complete search history.

(56) References Cited

U.S. PATENT DOCUMENTS

| | | | | |
|---|---|---|---|---|
| 2,718,501 | A | 9/1955 | Harle | |
| 2,958,663 | A | 11/1960 | Westcott et al. | |
| 3,345,292 | A | 10/1967 | Neal et al. | |
| 4,032,462 | A | 6/1977 | Hotten et al. | |
| 4,089,792 | A | 5/1978 | Lowe | |
| 4,102,796 | A | 7/1978 | Lowe | |
| 4,269,720 | A | 5/1981 | Bartleson et al. | |
| 4,358,387 | A * | 11/1982 | Zoleski | C10M 163/00 508/277 |
| 4,411,805 | A * | 10/1983 | Roberts | C10M 133/12 252/401 |
| 4,693,837 | A | 9/1987 | Dixon et al. | |
| 4,804,783 | A | 2/1989 | Nagata et al. | |
| 4,814,504 | A | 3/1989 | Malz, Jr. | |
| 4,871,875 | A | 10/1989 | Nagata et al. | |
| 4,952,731 | A | 8/1990 | Nagata et al. | |
| 6,133,480 | A | 10/2000 | Behre et al. | |
| 6,306,802 | B1 | 10/2001 | Shaub | |
| 7,501,386 | B2 * | 3/2009 | Cherpeck | C07D 215/38 508/261 |
| 2009/0287022 | A1 | 11/2009 | Patil et al. | |
| 2010/0217043 | A1 | 8/2010 | Patil et al. | |
| 2011/0230680 | A1 | 9/2011 | Patil et al. | |

FOREIGN PATENT DOCUMENTS

| | | |
|---|---|---|
| EP | 0147240 | 7/1985 |
| EP | 0482253 | 4/1992 |
| EP | 0557561 | 9/1993 |
| EP | 0613938 | 9/1994 |
| GB | 960493 | 6/1964 |

OTHER PUBLICATIONS

Chemistry, Biological Activity, and Uses of Formamidine Pesticides by R.M. Hollingworth, Environmental Health Perspectives, vol. 14, pp. 57-69, 1976.

Leslie R. Rudnick, "Lubricant Additives: Chemistry and Applications," New York, Marcel Dekker, Chapter 8, pp. 223-258 (2003).

Mortier et al., "Chemistry and Technology of Lubricants," 2nd Edition, London, Springer, Chapter 3, pp. 75-85 (1996).

Leslie R. Rudnick, "Lubricant Additives: Chemistry and Applications," New York, Marcel Dekker, Chapter 4, pp. 113-136 (2003).

Mortier et al., "Chemistry and Technology of Lubricants," 2nd Edition, London, Springer, Chapter 3, pp. 86-90 (1996).

Leslie R. Rudnick, "Lubricant Additives: Chemistry and Applications," New York, Marcel Dekker, Chapter 5, pp. 137-170 (2003).

Mortier et al., "Chemistry and Technology of Lubricants," 2nd Edition, London, Springer, Chapter 6, pp. 183-187 (1996).

Leslie R. Rudnick, "Lubricant Additives: Chemistry and Applications," New York, Marcel Dekker, Chapters 6 and 7, pp. 171-222 (2003).

Leslie R. Rudnick, "Lubricant Additives: Chemistry and Applications," New York, Marcel Dekker, Chapter 11, pp. 329-354 (2003).

Mortier et al., "Chemistry and Technology of Lubricants," 2nd Edition, London, Springer, Chapter 6, pp. 190-193 (1996).

* cited by examiner

*Primary Examiner* — Ellen McAvoy

(74) *Attorney, Agent, or Firm* — Carlton Virassammy

(57) ABSTRACT

The present invention provides a lubricating oil composition comprising:

(a) a major amount of a lubricating oil, (a) a diarylamine antioxidant, and (b) an amidine compound of Formula (I), Formula (I)

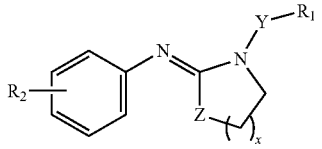

wherein $R_1$ is hydrogen, an alkyl or an aromatic group containing 1-30 carbon atoms; x is from 1 to 5; Y is an optional linking alkyl group; Z is carbon or nitrogen; and $R_2$ is hydrogen or alkyl groups containing 1-30 carbon atoms.

Also provided is a method for lubricating an engine comprising lubricating the engine with said lubricating oil composition.

16 Claims, No Drawings

LUBRICATING OIL COMPOSITIONS CONTAINING AMIDINE ANTIOXIDANTS

FIELD OF THE INVENTION

The present invention generally relates to amidine antioxidants and compositions containing same.

BACKGROUND OF THE INVENTION

Lubricating oils generally have a tendency to deteriorate due to oxidation and form decomposition products which can damage the machinery they lubricate. The oxidation is caused by exposure of hydrocarbons to oxygen, NOx and heat, and the reaction can be accelerated by the presence of transitional metals, such as copper, iron, etc. The internal combustion engine, especially in service, becomes an excellent chemical reactor for catalyzing the oxidation process when heat and engine metal parts act as effective oxidation catalysts. Hence, antioxidants play a very important role in protecting the lubricant from oxidative degradation.

Antioxidants can be grouped into primary and secondary antioxidants. Aromatic amines are considered as primary antioxidants. They act as radical scavengers by donating hydrogen atoms to terminate alkoxy and alkyl peroxy radicals and interrupting the radical chain mechanism. Secondary antioxidants are usually peroxide decomposers. They function by reducing alkyl hydroperoxides in the radical chain to nonradicals or less-reactive alcohols. On the other hand, peroxide is also a weak acid. A strong base should be able to neutralize the peroxide acid and decompose the peroxide by removing the proton. Commonly, peroxide decomposers can be sulfurized olefins, metal dithiocarbamates, metal dithiophospates, phosphites or thioesters, etc.

It is known that sulfur, phosphorous and ash content may negatively impact pollution, atmosphere and pollution control devices. With the increase in the awareness of the environmental protection and strictness in government regulations, there is a strong need for new antioxidants without any environmental side effects, but with improved antioxidancy performance. Hence, a low sulfur, low phosphorus, ashless (SAPS) peroxide decomposer is highly desired.

The following patent art teaches elements of the proposed invention, but none of them has mentioned the use of amidine compounds as antioxidants to lubricate engines.

U.S. Pat. No. 4,693,837 teaches the use of tertiary butyl derivatives of toluenediamine and specifically 5-tert-butyl-2,4-toluenediamine as an antioxidant material for preventing oxidation of organic materials.

U.S. Pat. No. 6,133,480 teaches the process of synthesizing N-phenyl-1-naphthylamine by the reaction of aniline and 1-naphthylamine in the liquid phase at 100-400° C. and normal ambient pressure is carried out in the presence of a catalyst mixture containing boron and fluorine.

U.S. Pat. No. 4,269,720 teaches that organic material such as lubricating oil can be stabilized against oxidative degradation by addition of an alkyl aniline compound, diphenylamine and/or N-(2-amino-3-ethyl-α-methylbenzylidene)-2,6-diethylaniline or mixtures thereof.

U.S. Pat. No. 4,866,209 teaches novel poly(hydrocarbylthio)anilines are 2,4,6-trisubstituted anilines wherein the substituents in at least two of the ortho and para positions are hydrocarbylthio substituents, any other p-substituent is hydrocarbyl or hydrocarbyloxy, any other ar-substituents are chloro, fluoro, hydrocarbyl, hydrocarbyloxy, and/or hydrocarbylthio, and any N-substituents are hydrocarbyl.

US20110230680 teaches a process of making N,N'-diaryl-o-phenylenediamine antioxidant, which involves reacting phenyl compound with aniline derivative in the presence of a palladium catalyst, or reacting phenyl compound with aniline derivative in the presence of a palladium catalyst.

US20090287022 teaches a process of preparing a catalytic antioxidant, which is a N,N'-diphenyl-benzene-1,4-diamine comprises: either reacting a 1,4-disubstituted arene with an aniline derivative in the presence of a palladium catalyst; or reacting a 1,4-diphenylenediamine with a substituted arene derivative in the presence of a palladium catalyst.

US20100217043 teaches a process s of making N,N'-diaryl-o-phenylenediamine catalytic antioxidant by reacting a substituted phenyl compound with aniline derivatives in the presence of palladium catalyst.

U.S. Pat. No. 4,814,504 teaches diphenylamine produced by contacting aniline with an alumina catalyst.

U.S. Pat. No. 4,804,783, U.S. Pat. No. 4,871,875 and U.S. Pat. No. 4,952,731 teach the processes for the production of diphenylamine or N,N'-diphenyl-phenylene diamine compounds from specific aniline compounds or specific phenylenediamine compounds by reacting with an excess of specific phenol compounds in the presence of hydrogen transfer catalysts and of a catalytic amount of cyclohexanone.

U.S. Pat. No. 2,718,501 teaches a synergistic mixture of a sulfur-containing compound, such as a wax sulfide or dioctadecyl disulfide, and an aromatic amine compound having at least 2 aromatic rings, such as phenyl alpha-naphthyl amine, for use in preventing oxidation in lubricating oils.

U.S. Pat. No. 2,958,663 teaches an extreme pressure lubricant composition containing from 0.01 to 5 percent each of sulfurized oleic acid, C18-C22 alkenyl succinic acid, chlorinated paraffin wax containing from 20-60 percent chlorine, diphenylamine and N'N-salicylal-1,2-propylenediamine.

U.S. Pat. No. 3,345,292 teaches stabilized alkyl substituted diaryl sulfides for use as functional fluids where the stablizer can be diaryl amine or alkylated phenol.

U.S. Pat. No. 4,032,462 teaches lubricants having improved antioxidancy having an oil soluble antimony compounds and an oil soluble antioxidant selected from sterically hindered phenols and thiophenols, and aromatic amines, and mixtures of these antioxidants.

U.S. Pat. No. 4,089,792 teaches lubricants having an antioxidant mixture of a primary amine and an antioxidant selected from aromatic or alkyl sulfides and polysulfides, sulfurized olefins, sulfurized carboxylic acid esters and sulfurized ester-olefins.

U.S. Pat. No. 4,102,796 teaches lubricant having an antioxidant mixture of aromatic and alkyl sulfides and polysulfides, sulfurized olefins, sulfurized carboxylic acid esters and sulfurized ester-olefins and a secondary aliphatic amine.

U.S. Pat. No. 6,306,802 teaches of an antioxidant mixture containing a combination of an oil soluble molybdenum compound and an aromatic amine.

"Chemistry, Biological Activity, and Uses of Formamidine Pesticides" by R. M. Hollingworth, *Environmental Health Perspectives*, vol 14, pp. 57-69, 1976 teaches the structure, properties, use and chemistry of formamdines in pesticides.

Thus, herein we report amidine antioxidant compounds and compositions containing same. These compounds and compositions show enhanced performance in engine oils when compared with industry standard antioxidants.

SUMMARY OF THE INVENTION

In accordance with one embodiment of the present invention, there is provided a lubricating oil composition comprising:

(a) a major amount of a lubricating oil,
(b) a diarylamine antioxidant, and
(c) an amidine compound of Formula (I), Formula (I)

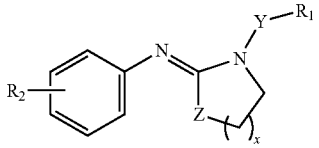

wherein $R_1$ is hydrogen, an alkyl or an aromatic group containing 1-30 carbon atoms; x is from 1 to 5; Y is an optional linking alkyl group; Z is carbon or nitrogen; and $R_2$ is hydrogen or alkyl groups containing 1-30 carbon atoms.

In another embodiment of the present invention, there is provided a method for lubricating an engine comprising lubricating the engine with a lubricating oil composition comprising:

(a) a major amount of a lubricating oil,
(b) a diarylamine antioxidant, and
(c) an amidine compound of Formula (I), Formula (I)

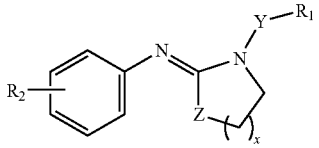

wherein $R_1$ is hydrogen, an alkyl or an aromatic group containing 1-30 carbon atoms; x is from 1 to 5; Y is an optional linking alkyl group; Z is carbon or nitrogen; and $R_2$ is hydrogen or alkyl groups containing 1-30 carbon atoms.

Also provided are lubricating oil compositions and additive concentrates comprising above compounds, and methods for operating an internal combustion engine using said lubricating oil compositions.

Definitions

The following terms will be used throughout the specification and will have the following meanings unless otherwise indicated.

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

DETAILED DESCRIPTION OF THE INVENTION

In one embodiment, the present invention provides amidine compounds which demonstrate antioxidant properties in lubricating oil compositions. In another embodiment, the amidine compounds demonstrate synergistic antioxidant properties when used in combination with other antioxidants in lubricating oil compositions.

Antioxidant synergism describes the effect or response of a combined use of two or more antioxidants being greater than that of any individual antioxidant. Synergistic antioxidant systems offer practical solutions to problems where using a single antioxidant is inadequate to provide satisfactory results, or where the treatment level has to be limited due to economic or environmental reasons.

Amidine Compounds

In one embodiment, the present invention provides lubricating oil compositions which comprise an amidine compound of Formula I, wherein $R_1$ is hydrogen, alkyl or aromatic groups containing 1-30 carbon atoms; x is from 1 to 5; Y is an optional linking alkyl group; Z is C or N; and $R_2$ is hydrogen or alkyl groups containing 1-30 carbon atoms.

Formula I

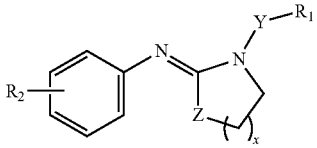

The amidine compound can be made by a nucleophilic addition followed by an elimination reaction between an aniline or an alkylated aniline and a cyclic compound with at least one nitrogen next to the carboxyl group in the presence of phosphorus oxycholoride and toluene as shown in Reaction 1, wherein $R_1$ is hydrogen, alkyl or aromatic groups containing 1-30 carbon atoms; x is from 1 to 5; Y is an optional linking alkyl group; Z is C or N; and $R_2$ is hydrogen or alkyl groups containing 1-30 carbon atoms.

Reaction I

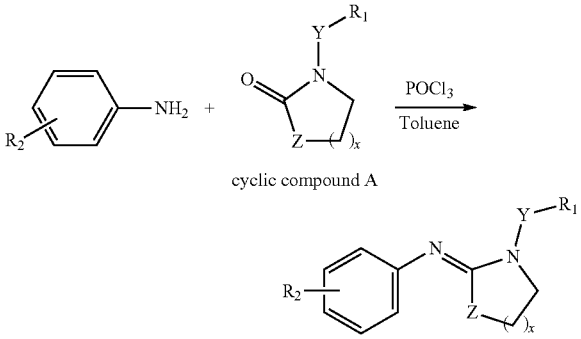

A method for preparing the amidine compound used in the present invention includes the following steps. To a solution of a cyclic compound A (with at least one nitrogen next to the carboxyl group) in Toluene, phosphorus (V) oxychloride was added dropwise at 0° C. The reaction was stirred at 0° C. for 2 hours. Aniline or alkylated aniline was added to the solution in one portion. The reaction mixture was refluxed under stirring for 4 hours. The organic layer was removed and the residue was dissolved in water. NaOH was added to adjust the solution PH to 10. Ethyl acetate was added for the extraction. The organic layer was collected, dried and removed. Optional purification step, e.g. flash-column chromatography, is used to purify the crude product.

In some embodiments, the alkylated aniline includes, but is not limited to, methylaniline, ethylaniline, propylaniline, butylaniline, pentylaniline, hexylaniline, heptylaniline, octylaniline, nonylaniline, decylaniline, undecylaniline, dodecylaniline, tridecylaniline, tetradecylaniline, pentadecylaniline, hexadecylaniline, heptadecylaniline, octadecylaniline, nonadecylaniline, eicosylaniline, naphthylaniline, naphthalenamine, anthrathenamine, naphthacenamine, pentacenamine, hexacenamine, heptacenamine. In one embodiment, the alkylated aniline is 4-butylaniline. In another embodiment, aniline is used.

In some embodiments, the cyclic compound A includes, but is not limited to lactam, piperidone, pyrrolidinone, pyrimidinone, imidazolidinone. In one embodiment, the cyclic compound A is a ϵ-caprolactam. In one embodiment, the cyclic amide is a valerolactam. In one embodiment, the cyclic amide is N-methylcaprolactam. In one embodiment, the cyclic compound A is N-methyl-2-piperidone. In one embodiment, the cyclic compound A is 1-methyl-2-pyrrolidinone. In one embodiment, the cyclic compound A is 1-benzyl-2-pyrrolidinone. In one embodiment, the cyclic compound A is 1,3-dimethyl-3,4,5,6-tetrahydro-2(1H)-pyrimidinone. In another embodiment, the cyclic compound A is 1,3-dimethyl-2-imidazolidinone.

In certain embodiments, the amount of the amidine compound in the lubricating oil compositions disclosed herein is at least about 0.01 wt. %, at least about 0.1 wt. %, at least about 0.2 wt. %, at least about 0.4 wt. %, at least about 0.5 wt. %, at least about 1.0 wt. %, at least about 1.5 wt. %, at least about 2 wt. %, or at least about 5 wt. %, based on the total weight of the lubricating oil composition, in one embodiment, the amount of amidine compound in the lubricating oil composition is 0.01 to 10 wt %. In one embodiment, the amount of amidine compound in the lubricating oil composistion is 0.1 to 10 wt %. In one embodiment, the amount of amidine compound in the lubricating oil composition is 0.1 to 5 wt %. In one embodiment, the amount of amidine compound in the lubricating oil composition is from greater than 0.5 wt % to 5 wt %. In one embodiment, the amount of amidine compound in the lubricating oil composition is 0.1 to 2%. In one embodiment, the amount of amidine compound in the lubricating oil composition s from greater than 0.5 to 2 wt %.

Diarylamine Compounds

In one embodiment, the lubricating oil compositions disclosed herein generally comprise at least one diarylamine compound. Any diarylamine compound that can reduce the tendency of the base oil to deteriorate in service can be used. Some non-limiting examples of suitable diarylamine compound include diphenylamine, phenyl-α-naphthylamine, alkylated diarylamines such as alkylated diphertylamines and alkylated phenyl-α-naphthylamirtes. In some embodiments, the diarylamine compound is an alkylated diphenylamine. In some embodiments, the diarylamine compound is diphenylamine, diarylamine compound may be used alone or in combination with other fabricating oil additives including other diarylamine compounds.

In one embodiment, the alkylated diphenylamine compounds can be represented by formula II:

Formula II

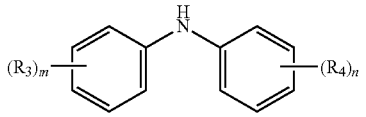

wherein each of $R_3$ and $R_4$ is independently hydrogen or an arylalkyl group having from about 7 to about 20, or from about 7 to about 10 carbons atoms; or a linear or branched alkyl group having from about 1 to about 24 carbon atoms; and each of m and n is independently 0, 1, 2, or 3, provided that at least one aromatic ring contains an arylalkyl group or a linear or branched alkyl group. In some embodiments, each of $R_3$ and $R_4$ is independently an alkyl group containing from about 4 to about 20, from about 4 to 16, from about 4 to about 12 carbon atoms, or from about 4 to about 8 carbon atoms.

In some embodiments, the alkylated diphenylamine includes, but is not limited to, bis-nonylated diphenylamine, bis-octylated diphenylamine, and octylated/butylated diphenylamine. In other embodiments, the alkylated diphenylamine comprises a first compound of formula (II) where each of $R_1$ and $R_4$ is independently octyl; and each of m and n is 1. In further embodiments, the alkylated diphenylamine comprises a second compound of Formula II where each of $R_3$ and $R_4$ is independently butyl; and each of m and n is 1. In still further embodiments, the alkylated diphenylamine comprises a third compound of Formula II where $R_3$ is octyl and $R_4$ is butyl; and each of m and n is 1. In still further embodiments, the alkylated diphenylamine comprises a fourth compound of Formula II where $R_3$ is octyl; m is 2 and n is 0. In still further embodiments, the alkylated diphenylamine comprises a fifth compound of Formula II where $R_3$ is butyl; m is 2 and a is 0. In certain embodiments, the alkylated diphenylamine comprises the first compound, second compound, third compound, fourth compound, fifth compound or a combination thereof.

In certain embodiments, the amount of the diarylamine compound, such as the alkylated diphenylamines, in the lubricating oil compositions disclosed herein is at least about 0.01 wt. %, at least about 0.05 wt. %, at least about 0.1 wt. %, at least about 0.2 wt. %, at least about 0.5 wt. %, at least about 0.8 wt. %, at least about 1.0 wt. %, at least about 1.5 wt. %, at least about 2 wt. %, or at least about 5 wt. %, based on the total weight of the lubricating oil composition. In one embodiment, the amount of diarylamine compound in the lubricating oil composition is 0.01 to 10 wt %. In one embodiment, the amount of diarylamine compound in the lubricating oil composition is 0.1 to 10 wt %. In one embodiment, the amount of diarylamine compound in the lubricating oil composition is 0.2 to 10 wt %. In one embodiment, the amount of diarylaminecompound in the lubricating oil composition is 0.1 to 5 wt %. In one embodiment, the amount of diarylamine compound in the lubricating oil composition is 0.1 to 2 wt %. In one embodiment, the amount of diarylamine compound in the lubricating oil composition is 0.1 to 1 wt %.

Molybdated Compound

The molybdenum-containing compoundemployed in the present invention may be sulfurized or unsulfurized. It is generally characterized as an oxymolybdenum complex of a basic nitrogen compound. Such molybdenum/sulfur complexes are known in the art and are described, for example, in U.S. Pat. No. 4,263,152 to King et al., the disclosure of which is hereby incorporated by reference.

The structure of the molybdenum compositions employed in this invention are not known with certainty; however, they are believed to be compounds in which molybdenum, whose valences are satisfied with atoms of oxygen or sulfur, is either complexed by, or the salt of, one or more nitrogen atoms of the basic nitrogen containing compound used in the preparation of these compositions.

The molybdenum compounds used to prepare the oxymolybdenum and oxymolybdenum/sulfur complexes employed in the present invention are acidic molybdenum compounds. By acidic is meant that the molybdenum compounds will react with a basic nitrogen compound as measured by ASTM test D-664 or D-2896 titration procedure Typically these molybdenum compounds are hexavalent and are represented by the following compositions: molybdic acid, ammonium molybdate, sodium molybdate, potassium molybdate and other alkaline metal molybdates and other molybdenum salts such as hydrogen salts, e.g., hydrogen sodium molybdatc, $MoOCl_4$, $MoO_2Br_2$, $Mo_2O_3Cl_6$, molybdenum trioxide or similar acidic molybdenum compounds. Preferred acidic molybdenum compounds are molybdic acid, ammonium molybdate, and alkali metal molybdates. Particularly preferred are molybdic acid and ammonium molybdate.

The basic nitrogen compound used to prepare the oxymolybdenum complexes have at least one basic nitrogen and are preferably oil-soluble. Typical examples of such compositions are succinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof. Any of the nitrogen-containing compositions may be after-treated with, e.g., boron, using procedures well known in the art so long as the compositions continue to contain basic nitrogen. These after-treatments are particularly applicable to succinimides and Mannich base compositions.

The mono and polysuccinimides that can be used to prepare the molybdenum complexes described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amities being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof.

Also included within the term "succinimide" are the co-oligomers of a hydrocarbyl succinic acid or anhydride and a poly secondary amine containing at least one tertiary amino nitrogen in addition to two or more secondary amino groups. Ordinarily this composition has between 1500 and 50000 average molecular weight. A typical compound would be that prepared by reacting polyisobutenyl succinic anhydride and ethylene dipiperazine.

Carboxylic acid amide compositions are also suitable starting materials for preparing the oxymolybdenum complexes employed in this invention. Typical of such compounds are those disclosed in U.S. Pat. No. 3,405,064, the disclosure of which is hereby incorporated by reference. These compositions are ordinarily prepared by reacting a carboxylic acid or anhydride or ester thereof, having at least 12 to about 350 aliphatic carbon atoms in the principal aliphatic chain and, if desired, having sufficient pendant liphatic groups to render the molecule oil soluble with an amine or a hydrocarbyl polyamine, such as an ethylene amine, to give a mono or polycarboxylic acid amide. Preferred are those amides prepared from (1) a carboxylic acid of the formula R'COOH, where R' is $C_{12-20}$ alkyl or a mixture of this acid with a polyisobutenyl carboxylic acid in which the polyisobutenyl group contains from about 72 to 128 carbon atoms and (2) an ethylene amine, especially triethylene tetramine or tetraethylene pentamine or mixtures thereof.

Another class of compounds which are useful in this invention are hydrocarbyl monoamines and hydrocarbyl polyamines, preferably of the type disclosed in U.S. Pat. No. 3,574,576, the disclosure of which is hereby incorporated by reference. The hydrocarbyl group, which is preferably alkyl, or olefinic having one or two sites of unsaturation, usually contains from about 9 to 350, preferably from about 20 to 200 carbon atoms. Particularly preferred hydrocarbyl polyamines are those which are derived, e.g., by reacting polyisobutenyl chloride and a polyalkylene polyamine, such as an ethylene amine, e.g., ethylene diamine, diethylene triamine, tetraethylene pentamine, 2-aminoethylpiperazine, 1,3-propylene diamine, 1,2-propylenediamine, and the like.

Another class of compounds useful for supplying basic nitrogen are the Mannich base compounds. These compounds are prepared from a phenol or $C_{9-200}$ alkylphenol, an aldehyde, such as formaldehyde or formaldehyde precursor such as paraformaldehyde, and an amine compound. The amine may be a mono or polyamine and typical compositions are prepared from an alkylamine such as methylamine or an ethylene amine, such as, diethylene triamine, or tetraethylene pentamine, and the like. The phenolic material may be sulfurized and preferably is dodecylphenol or a $C_{80-100}$ alkylphenol. Typical Mannich bases which can be used in this invention are disclosed in U.S. Pat. Nos. 4,157,309 and 3,649,779; 3,368,972; and 3,539,663, the disclosures of which are hereby incorporated by reference. The last referenced patent discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of from about 2 to 6 carbon atoms and n is from about 1-10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Another class of composition useful for preparing the oxymolybdenum complexes employed in this invention are the phosphoramides and phosphonamides such as those disclosed in U.S. Pat. Nos. 3,909,430 and 3,968,157, the disclosures of which are hereby incorporated by reference. These compositions may be prepared by forming a phosphorus compound having at least one P—N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoramides can be prepared by reacting an unsaturated hydrocarbon compound containing from about 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylamine, alkyldiamine alkylpolyamine, or an alkyleneamine, such as ethylene diamine, diethylenetriamine, triethylenetetramine, tetraethylenepentamine, and the like.

Another class of nitrogen-containing compositions useful in preparing the molybdenum complexes employed in this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups on the polymer backbone. Commonly used nitrogen sources include any basic nitrogen compound especially those nitrogen-containing compounds and compositions described herein. Preferred nitrogen sources are alkylene amines, such as ethylene amities, alkyl amities, and Mannich bases.

Preferred basic nitrogen compounds for use in this invention are succinimides, carboxylic acid amides, and Mannich bases. More preferred are succinimides having an average molecular weight of 1000 or 1300 or 2300 and mixtures thereof. Such succinimides can be post treated with boron or ethylene carbonate as known in the art.

The oxymolybdenum complexes of this invention can also be sulfurized. Representative sulfur sources for preparing the oxymolybdenum/sulfur complexes used in this invention are sulfur, hydrogen sulfide, sulfur monochloride, sulfur dichloride, phosphorus pentasulfide, $R''_2—S_x$ where R" is hydrocarbyl, preferably $C_{1-40}$ alkyl, and x is at least 2, inorganic sulfides and polysulfides such as $(NH_4)_2S_y$, where y is at least 1, thioacetamide, thiourea, and mercaptans of the formula R"SH where R" is as defined above. Also useful as sulfurizing agents are traditional sulfur-containing antioxidants such as wax sulfides and polysulfides, sulfurized olefins, sulfurized carboxylic and esters and sulfurized ester-olefins, and sulfurized alkylphenols and the metal salts thereof.

Sulfurized alkyl phenols and the metal salts thereof include compositions such as sulfurized dodecylphenol and the calcium salts thereof. The alkyl group ordinarily contains from about 9 to 300 carbon atoms. The metal salt may be preferably, a Group I or Group II salt, especially sodium, calcium, magnesium, or barium.

Preferred sulfur sources are sulfur, hydrogen sulfide, phosphorus pentasulfide, $R'''_2S_z$ Where R''' is hydrocarbyl, preferably $C_1$-$C_{10}$ alkyl, and z is at least 3, mercaptans wherein R''' is $C_1$-$C_{10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

The polar promoter used in the preparation of the molybdenum complexes employed in this invention is one which facilitates the interaction between the acidic molybdenum compound and the basic nitrogen compound. A wide variety of such promoters are well known to those skilled in the art. Typical promoters are 1,3-propanediol, 1,4-butane-diol, diethylene glycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water.

While ordinarily the polar promoter is separately added to the reaction mixture, it may also be present, particularly in the case of water, as a component of non-anhydrous starting materials or as waters of hydration in the acidic molybdenum compound, such as $(NH_4)_6Mo_7O_{24}.H_2O$. Water may also be added as ammonium hydroxide.

A method for preparing the oxymolybdenum complexes used in this invention is to prepare a solution of the acidic molybdenum precursor and a polar promoter with a basic nitrogen-containing compound with or without diluent. The diluent is used, if necessary, to provide a suitable viscosity for easy stirring. Typical diluents are lubricating oil and liquid compounds containing only carbon and hydrogen. If desired, ammonium hydroxide may also be added to the reaction mixture to provide a solution of ammonium molybdate. This reaction is carried out at a variety of temperatures, typically at or below the melting point of the mixture to reflux temperature. It is ordinarily carried out at atmospheric pressure although higher or lower pressures may be used if desired. This reaction mixture may optionally be treated with a sulfur source as defined above at a suitable pressure and temperature for the sulfur source to react with the acidic molybdenum and basic nitrogen compounds. In some cases, removal of water from the reaction mixture may be desirable prior to completion of reaction with the sulfur source.

In a preferred and improved method for preparing the oxymolybdenum complexes, the reactor is agitated and heated at a temperature less than or equal to about 120° C., preferably from about 70° C. to about 90° C. Molybdic oxide or other suitable molybdenum source is then charged to the reactor and the temperature is maintained at a temperature less than or equal to about 120° C., preferably at about 70° C. to about 90° C., until the molybdenum is sufficiently reacted. Excess water is removed from the reaction mixture. Removal methods include but are not limited to vacuum distillation or nitrogen stripping while maintaining the temperature of the reactor at a temperature less than or equal to about 120° C., preferably between about 70° C. to about 90° C. The temperature during the stripping process is held at a temperature less than or equal to about 120° C. to maintain the low color intensity of the molybdenum-containing composition. It is ordinarily carried out at atmospheric pressure although higher or lower pressures may be used. The stripping step is typically carried out for a period of about 0.5 to about 5 hours.

If desired, this product can be sulfurized by treating this reaction mixture with a sulfur source as defined above at a suitable pressure and temperature, no to exceed about 120° C. for the sulfur source to react with the acidic molybdenum and basic nitrogen compounds. The sulfurization step is typically carried out for a period of from about 0.5 to about 5 hours and preferably from about 0.5 to about 2 hours. In some cases, removal of the polar promoter (water) from the reaction mixture may be desirable prior to completion of reaction with the sulfur source. The oxymolybdenum complex and oxymolybdenum/sulfur complex produced by such method is lighter in color (when compared to complexes prepared at higher temperatures) while maintaining good fuel economy, excellent oxidation inhibition, and anti-wear performance qualities. Color in this instance can be more visibly or more quantifiably using a UV spectrophotometer such as a Perkin-Elmer Lambda 18 UV-Visible Double-Beam Spectrophotometer. As used herein, this test recorded the visible spectra of molybdenum compositions at a constant concentration in an isooctane solvent. The spectra represent the absorbance intensity plotted versus the wavelength in nanometers. The spectra extend from the visible region into the near infrared region of the electromagnetic radiation (350 nanometers to 900 nanometers). In this test, the highly colored samples showed increasingly higher absorbance at increasingly higher wavelengths at a constant molybdenum concentration. The preparation of the sample for color measurement comprises diluting the molybdenum-containing composition with isooctane to achieve a constant molybdenum concentration of 0.00025 g molybdenum per gram of the molybdenum-containing composition/isooctane mixture. Prior to sample measurement the spectrophotometer is referenced by scanning air versus air. The UV visible spectrum from 350 nanometers to 900 nanometers is obtained using a one centimeter path-length quartz cell versus an air reference. The spectra are offset corrected by setting the 867 nanometer absorbance to zero. Then the absorbance of the sample is determined at 350 nanometers wavelength.

Characteristics of these new oxymolybdenum/sulfur complexes are disclosed in U.S. patent application Ser. No. 10/159,446 filed May 31, 2002, entitled REDUCED COLOR MOLYBDENUM-CONTAINING COMPITION AND A METHOD OF MAKING SAME, incorporated herein by reference in its entirety.

In the reaction mixture, the ratio of molybdenum compound to basic nitrogen compound is not critical; however, as the amount of molybdenum with respect to basic nitrogen increases, the filtration of the product becomes more difficult. Since the molybdenum component probably oligotnerizes, it is advantageous to add as much molybdenum as can easily be maintained in the composition. Usually, the reaction mixture will have charged to it from about 0.01 to 2.00 atoms of molybdenum per basic nitrogen atom. Preferably from about 0.3 to 1.0, and most preferably from about 0.4 to 0.7, atoms of molybdenum per atom of basic nitrogen is added to the reaction mixture.

When optionally sulfurized, the sulfurized oxymolybdenum containing compositions may be generally characterized as a sulfur/molybdenum complex of a basic nitrogen dispersant compound preferably with a sulfur to molybdenum weight ratio of from about (0.01 to 1.0) to 1 and more preferably from about (0.05 to 0.5) to 1 and a nitrogen to molybdenum weight ratio of from about (1 to 10) to 1 and more preferably from about to (2 to 5) to 1. For extremely low sulfur incorporation the sulfur to molybdenum weight ratio can be from about (0.01 to 0.08) to 1.

The oxymolybdenum-containing complex comprises from about 0.02 to 10 wt % and preferably from about 0.1 to 2.0 wt %, based on the total weight of the lubricating oil composition.

If desired, other additives known in the art may be added to the lubricating oil basestock. Such additives include dispersants, detergents, antiwear agents, extreme pressure agents, antioxidants, rust inhibitors, corrosion inhibitors, pour point depressants, viscosity index improvers, other friction modifiers and the like.

Additional Lubricating Oil Additives

Optionally, the lubricating oil composition may further comprise at least an additive or a modifier (hereinafter designated as "additive") that can impart or improve any desirable property of the lubricating oil composition. Any additive known to a person of ordinary skill in the art may be used in the lubricating oil compositions disclosed herein. Some suitable additives have been described in Mortier et al., "*Chemistry and Technology of Lubricants,*" 2nd Edition, London, Springer, (1996); and Leslie R. Rudnick, "*Lubricant Additives: Chemistry and Applications*," New York, Marcel Dekker (2003), both of which are incorporated herein by reference. In some embodiments, the additive can be selected from the group consisting of antioxidants, anti-wear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof. In general, the concentration of each of the additives in the lubricating oil composition, when used, pray range from about 0.001 wt. % to about 10 wt. %, from about 0.01 wt to about 5 wt. %, or from about 0.1 wt. % to about 2.5 wt. % based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The lubricating oil composition disclosed herein can optionally comprise an anti-wear agent that can reduce friction and excessive wear, Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphate, metal (e.g., Zn, Pb, Sb, Mo and the like) salts of dithiocarbamate, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-wear agents have been described in Leslie R. Rudnick, "*Lubricant Additives: Chemistry and Applictions*," New York, Marcel Dekker, Chapter 8, pages 223-258 (2003), which is incorporated herein by reference.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphosphorus content. In some embodiments, the phosphosphorus content of the lubricating oil composition disclosed herein is from about 0.01 wt. % to about 0.12 wt. %, from about 0.01 wt. % to about 0.10 wt. %, or from about 0.02 wt. % to about 0.08 wt. %, based on the total weight of the lubricating oil composition.

In one embodiment, the phosphorous content of the lubricating oil composition herein is from about 0.01 to 0.08 wt % based on the total weight of the lubricating oil composition. In another embodiment, the phosphorous content of the lubricating oil composition herein is from about 0.05 to 0.12 wt % based on the total weight of the lubricating oil composition.

The dihydrocarbyl dithiophosphate metal salt may be prepared in accordance with known techniques by first forming a dihydrocarbyl dithiophosphoric acid (DDPA), usually by reacting one or more of alcohols and phenolic compounds with $P_2S_5$ and then neutralizing the formed DDPA with a compound of the metal, such as an oxide, hydroxide or carbonate of the metal. In some embodiments, a DDPA may be made by reacting mixtures of primary and secondary alcohols with $P_2S_5$. In other embodiments, two or more dihydrocarbyl dithiophosphoric acids can be prepared where the hydrocarbyl groups on one are entirely secondary in character and the hydrocarbyl groups on the others are entirely primary in character. The zinc salts can be prepare from the dihydrocarbyl dithiophosphoric acids by reacting with a zinc compound. In some embodiments, a basic or a neutral zinc compound is used. In other embodiments, an oxide, hydroxide or carbonate of zinc is used.

In some embodiments, oil soluble zinc dialkyl dithiophosphates may be produced from dialkyl dithiophosphoric acids represented by formula (III):

Formula (III)

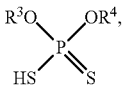

wherein each of $R^3$ and $R^4$ is independently linear or branched alkyl or linear or branched substituted alkyl. In some embodiments, the alkyl group has from about 3 to about 30 carbon atoms or from about 3 to about 8 carbon atoms.

The dialkyldithiophosphoric acids of formula (III) can be prepared by reacting alcohols $R^3OH$ and $R^4OH$ with $P_2S_5$ where $R^3$ and $R^4$ are as defined above. In some embodiments, $R^3$ and $R^4$ are the same. In other embodiments, $R^3$ and $R^4$ are different. In further embodiments, $R^3OH$ and $R^4OH$ react with $P_2S_5$ simultaneously. In still further embodiments, $R^3OH$ and $R^4OH$ react with $P_2S_5$ sequentially.

Mixtures of hydroxyl alkyl compounds may also be used. These hydroxyl alkyl compounds need not be monohydroxy alkyl compounds. In some embodiments, the dialkyldithiophosphoric acids is prepared from mono-, di-, tetra-, and other polyhydroxy alkyl compounds, or mixtures of two or more of the foregoing. In other embodiments, the zinc dialkyldithiosphate derived from only primary alkyl alcohols is derived from a single primary alcohol. In further embodiments, that single primary alcohol is 2-ethylhexanol. In certain embodiments, the zinc dialkyldithiophosphate derived from only secondary alkyl alcohols. In further embodiments, that mixture of secondary alcohols is a mixture of 2-butanol and 4-methyl-2-pentanol.

The phosphorus pentasulfide reactant used in the dialkyldithiophosphoric acid formation step may contain certain amounts of one or more of $P_2S_3$, $P_4S_3$, $P_4S_7$, or $P_4S_9$. Compositions as such may also contain minor amounts of free sulfur. In certain embodiments, the phosphorus pentasulfide reactant is substantially free of any of $P_2S_3$, $P_4S_3$, $P_4S_7$, and $P_4S_9$. In certain embodiments, the phosphorus pentasulfide reactant is substantially free of free sulfur.

In the present invention, the sulfated ash content of the total lubricating oil composition is about 5 wt. %, about 4 wt. %, about 3 wt. %, about %, or about 1 wt. %, as measured according to ASTM D874.

In some embodiments, the lubricating oil composition comprises at least a detergent. Any compound or a mixture of compounds that can reduce or slow the build up of engine deposits can be used as a detergent. Some non-limiting examples of suitable detergents include polyolefin substituted succinimides or succinamides of polyamines for instance polyisobutylene succinimides or polyisobutylene amine succinamides, aliphatic amines, Mannich bases or amines and polyolefin (e.g., polyisobutylene) maleic anhydrides. Some suitable succinimide detergents are described in GB960493, EP0147240, EP0482253, EP0613938, EP0557561 and WO 98/42808, all of which are incorporated herein by reference. In some embodiments, the detergent is a polyolefin substituted succinimide such as polyisobutylene succinimide. Some non-limiting examples of commercially available detergent additives include F7661 and F7685 (available from Infineum, Linden, N.J.) and OMA 4130D (available from Octel Corporation, Manchester, UK).

Some non-limiting examples of suitable metal detergent include sulfurized or unsulfurized alkyl or alkenyl phenates, alkyl or alkenyl aromatic sulfonates, borated sulfonates, sulfurized or unsuffurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, phenates, salicylates, phosphonates, thiophosphortates and combinations thereof. The metal can be any metal suitable for making sulfonate, phenate, salicylate or phosphonate detergents. Non-limiting examples of suitable metals include alkali metals, alkaline metals and transition metals. In some embodiments, the metal is Ca, Mg, Ba, K, Na, Li or the like.

Generally, the amount of the detergent is from about 0.001 wt. % to about 5 wt. %, from about 0.05 wt. % to about 3 wt. %, or from about 0.1 wt. % to about 1 wt. %, based on the total weight of the lubricating composition. Some suitable detergents have been described in Mortier et al., "*Chemistry and Technology of Lubricants,*" 2nd Edition, London, Springer, Chapter 3, pages 75-85 (1996); and Leslie R. Rudnick, "*Lubricant Additives: Chemisuy and Applications*," New York, Marcel Dekker, Chapter 4, pages 113-136 (2003), both of which are incorporated herein by reference.

The lubricating oil composition disclosed herein can optionally comprise a dispersant that can prevent sludge, varnish, and other deposits by keeping particles suspended in a colloidal state. Any dispersant known by a person of ordinary skill in the art may be used in the lubricating oil composition. Non-limiting examples of suitable dispersants include alkenyl succinimides, alkenyl succinimides modified with other organic compounds, alkenyl succinimides modified by post-treatment with ethylene carbonate or boric acid, succiamides, succinate esters, succinate ester-amides, pentaerythritols, phenate-salicylates and their post-treated analogs, alkali metal or mixed alkali metal, alkaline earth metal borates, dispersions of hydrated alkali metal borates, dispersions of alkaline-earth metal borates, polyimide ashless dispersants, benzylamines, Mannich type dispersants, phosphorus-containing dispersants, and combinations thereof. The amount of the dispersant may vary from about 0.01 wt. % to about 10 wt. %, from about 0.05 wt % to about 7 wt. %, or from about 0.1 wt. % to about 4 wt. %, based on the total weight of the lubricating oil composition. Some suitable dispersants have been described in Monier et al., "*Chemistry and Technology of Lubricants,*" 2nd Edition, London, Springer, Chapter 3, pages 86-90 (1996); and Leslie R. Rudnick, "*Lubricant Additives: Chemistry and Applications*," New York, Marcel Dekker, Chapter 5, pages 137-170 (2003), both of which are incorporated herein by reference.

The lubricating oil composition disclosed herein can optionally comprise a friction modifier that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphoric acids; mono-, di- or substituted amines mono- or di-alkyl substituted amides and combinations thereof. In some embodiments, the friction modifier is selected from the group consisting of aliphatic amines, ethoxylated aliphatic amines, aliphatic carboxylic acid amides, ethoxylated aliphatic ether amines, aliphatic carboxylic acids, glycerol esters, aliphatic carboxylic ester-amides, fatty imidazolines, fatty tertiary amines, wherein the aliphatic or fatty group contains more than about eight carbon atoms so as to render the compound suitably oil soluble. In other embodiments, the friction modifier comprises an aliphatic substituted succinimide formed by reacting an aliphatic succinic acid or anhydride with ammonia or a primary amine. The amount of the friction modifier may vary from about 0.01 wt. % to about 10 wt. %, from about 0.05 wt % to about 5 wt %, or from about 0.1 wt. % to about 3 wt. %, based on the total weight of the lubricating oil composition. Some suitable friction modifiers have been described in Mortier et al., "*Chemistry and Technology of Lubricants,*" 2nd Edition, London, Springer, Chapter 6, pages 183-187 (1996); and Leslie R. Rudnick, "*Lubricant Additives: Chemistry and Applications*," New York, Marcel Dekker, Chapters 6 and 7, pages 171-222 (2003), both of which are incorporated herein by reference.

The lubricating oil composition disclosed herein can optionally comprise a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et at, "*Chemistry and Technology of Lubricants,*" 2nd Edition, London, Springer, Chapter 6, pages 187-189 (1996); and Leslie R. Rudnick, "*Lubricant Additives: Chemistly and Applications*," New York, Marcel Dekker, Chapter 11, pages 329-354 (2003), both of which are incorporated herein by reference.

The lubricating oil composition disclosed herein can optionally comprise a demulsifier that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt, % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "*Chemistry and Technology of Lubricants,*" 2nd Edition, London, Springer, Chapter 6, pages 190-193 (1996), which is incorporated herein by reference.

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Not-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam my vary from about 0.01 wt % to about 5 wt. %, from about 0.05 wt. % to about 3 wt. %, or from about 0.1 wt % to about 1 wt. %, based on the total weight of the lubricating oil composition. Some suitable anti-foams have been described in Monier et al., "*Chemistry and Technology of Lubricants,*" 2nd Edition, London, Springer, Chapter 6, pages 190-193 (1996), which is incorporated herein by reference.

The lubricating oil composition disclosed herein can optionally comprise a corrosion inhibitor that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition. Some suitable corrosion inhibitors have been described in Mortier et al., "*Chemistiy and Technology of Lubricants,*" 2nd Edition, London, Springer, Chapter 6, pages 193-196 (1996), which is incorporated herein by reference.

The lubricating oil composition disclosed herein can optionally comprise an extreme pressure (EP) agent that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thioptiosphoric acid esters and combinations thereof. The amount of the extreme pressure agent may vary from about 0.01 wt. % to oboni 5 wt %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "*Lubricant Additives: Chemistry and Applications*," New York, Marcel Dekker, Chapter 8, pages 223-258 (2003), which is incorporated herein by reference.

The lubricating oil composition disclosed herein can optionally comprise a rust inhibitor that can inhibit the corrosion of ferrous metal surfaces. Any rust inhibitor known by a person of ordinary skill in the art may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linolkic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha, omega-dicarboxylic acids having a molecular weight in the range of 600 to 3000 daltons and combinations thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher lcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

In certain embodiments, the lubricating oil composition comprises at least a viscosity index improver. Some non-limiting examples of suitable viscosity index improvers include poly methacrylate type polymers, ethylene-propylene copolymers, styrene-isoprene copolymers, hydrated styrene-isoprene copolymers, polyisobutylene, and dispersant type viscosity index improvers.

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 centistokes to about 35 centistokes at 40° C.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, may range, unless otherwise specified, from about 0.001 wt. % to about 10 wt. %, in one embodiment from about 0.005 wt. % to about 5 wt. %, or in one embodiment from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oil moral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 centistokes to about 35 centistokes at 40° C.

Generally, it is desired that the diluent readily solubilizes the lubricating oil soluble additive of the invention and provides an oil additive concentrate that is readily soluble in the lubricant base oil stocks or fuels. In addition, it is desired that the diluent not introduce any undesirable characteristics, including, for example, high volatility, high viscosity, and impurities such as heteroatoms, to the lubricant base oil stocks and thus, ultimately to the finished lubricant or fuel.

The present invention further provides an oil soluble additive concentrate composition comprising an inert diluent and from 2.0% to 90% by weight, preferably 10% to 50% by weight based on the total concentrate, of an oil soluble additive composition according to the present invention.

The Oil of Lubricating Viscosity

The lubricating oil compositions disclosed herein generally comprise at least one oil of lubricating viscosity. Any base oil known to a skilled artisan can be used as the oil of lubricating viscosity disclosed herein. Some base oils suitable for preparing the lubricating oil compositions have been described in Mortier et al., "*Chemistry and Technology of Lubricants,*" 2nd Edition, London, Springer, Chapters 1 and 2 (1996); and A. Sequeria, Jr., "*Lubricant Base Oil and Wax Processing*," New York, Marcel Decker, Chapter 6, (1994); and D. V. Brock, *Lubrication Engineering*, Vol. 43, pages 184-5, (1987), all of which are incorporated herein by reference. Generally, the amount of the base oil in the lubricating oil composition may be from about 70 to about 99.5 wt. %, based on the total weight of the lubricating oil composition. In some embodiments, the amount of the base oil in the lubricating oil composition is from about 75 to about 99 wt. %, from about 80 to about 98.5 wt. %, or from about 80 to about 98 wt. %, based on the total weight of the lubricating oil composition. The expression "base oil" as used herein shall be understood to mean a base stock or blend of base stocks which is a lubricant component that is produced by a single manufacturer to the same specifications (independent of feed source or manufacturers location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. For example, the base oils can be used in formulating lubricating oil compositions for any and all such applications such as passenger car engine oils, heavy duty diesel motor oils and natural gas engine oils.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process. In certain embodiments, the base oil comprises less than about 10 wt. % of one or more heavy fractions, based on the total weight of the base oil. A heavy fraction refers to a tube oil fraction having a viscosity of at least about 20 cSt at 100° C. In certain embodiments, the heavy fraction has a viscosity of at least about 25 cSt or at least about 30 cSt at 100° C. In further embodiments, the amount of the one or more heavy fractions in the base oil is less than about 10 wt. %, less than about 5 wt. %, less than about 2.5 wt. %, less than about 1 wt. %, or less than about 0.1 wt. %, based on the total weight of the base oil. In still further embodiments, the base oil comprises no heavy fraction.

In certain embodiments, the lubricating oil compositions comprise a major amoun of a base oil of lubricating viscosity. In some embodiments, the base oil has a kinematic viscosity at 100° C. from about 2.5 centistokes (cSt) to about 20 cSt, from about 4 centistokes (cSt) to about 20 cSt, or from about 5 cSt to about 16 cSt. The kinematic viscosity of the base oils or the lubricating oil compositions disclosed herein can be measured according to ASTM D 445, which is incorporated herein by reference.

In other embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the base oil comprises me or more of the base stocks in one or more of Groups I-V as specified in the American Petroleum Institute (API) Publication 1509, Fourteen Edition, December 1996 (i.e., API Base Oil interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

In some embodiments, the base oil comprises one or more of the base stocks in Group I, II, III, IV, V or a combination thereof. In other embodiments, the base oil comprises one or more of the base stocks in Group II, III, IV or a combination thereof. In further embodiments, the base oil comprises one or more of the base stocks in Group II, III, IV or a combination thereof wherein the base oil has a kinematic viscosity from about 2.5 centistokes (cSt) to about 20 cSt, from about 4 cSt to about 20 cSt, or from about 5 cSt to about 16 cSt at 100° C.

The base oil may be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the base oil of lubricating viscosity includes natural oils, such as animal oils, vegetable oils, mineral oils (e.g., liquid petroleum oils and solvent treated or acid-treated mineral oils of the paraffinic, naphthenic or mixed paraffinic-naphthenic types), oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In some embodiments, the synthetic oils of lubricating viscosity include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxyhe acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyakyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisotnerization catalyst.

In further embodiments, the base oil comprises a poly-alpha-olefin (PAO). In general, the poly-alpha-olefins may be derived from an alpha-olefin having from about 2 to about 30, from about 4 to about 20, or from about 6 to about 16 carbon atoms. Non-limiting examples of suitable poly-alpha-olefins include those derived from octene, decene, mixtures thereof, and the like. These poly-alpha-olefins may have a viscosity from about 2 to about 15, from about 3 to about 12, or from about 4 to about 8 centistokes at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalklene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl subacute, diisooctyl azelate, diisodecyl azelate, dioctyl phthalate, didecyl phthalate, dieicosyl sebacate, the 2-ethylhexyl diester, of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

The applications to which the lubricating oil compositions of this invention may be put are not particularly limited, and include e.g. marine cylinder lubricants, trunk piston engine oils, and system oils; automotive engine oils; railroad engine oils; stationary engine oils such as natural gas engine oils; greases; and functional fluids such as tractor hydraulic fluids, gear oils, antiwear hydraulic oils, and transmission fluids.

EXAMPLES

The following examples are intended for illustrative purposes only and do not limit in any way the scope of the present invention.

Compound 1

To a solution of ϵ-caprolactam (5.6 g, 50 mmol) in Toluene (150 mL) was added phosphorus (V) oxychloride (2.33 mL, 25 mmol) dropwise at 0° C. The reaction was stirred at 0° C. for 2 hours. Aniline (2.28 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was recrystallized in the mixture of Ethyl acetate and Hexanes (1:1) to give the compound (3.28 g) as yellow crystals.

Compound 1

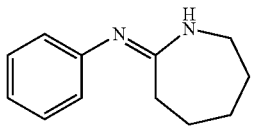

Compound 2

To a solution of valerolactam (4.96 g, 50 mmol) in Toluene (150 mL) was added phosphorus (V) oxychloride (2.33 mL, 25 mmol) dropwise at 0° C. The reaction was stirred at 0° C. for 2 hours. Aniline (2.28 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was purified by flash-column chromatography (triethylamine 3% in ethyl acetate) to give the compound (2.3 g) as yellow solid.

Compound 2

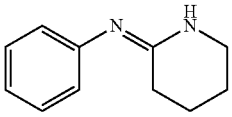

Compound 3

To a solution of N-methylcaprolactam (6.4 mL, 50 mmol) in Toluene (150 mL) was added phosphorus (V) oxychloride (2.33 mL, 25 mmol) dropwise at 0° C. The reaction was stirred at 0° C. for 2 hours. Aniline (2.28 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was purified by flash-column chromatography (triethylamine 3% in ethyl acetate) to give the compound (3.4 g) as light yellow oil.

Compound 3

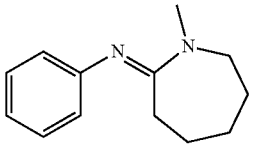

Compound 4

To a solution of N-methyl-2-piperidone (5.71 mL, 50 mmol) in Toluene (150 mL) was added phosphorus (V) oxychloride (2.33 mL, 25 mmol) dropwise at 0° C. The reaction was stirred at 0° C. for 2 hours. Aniline (2.28 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was purified by flash-column chromatography (triethylamine 3% in ethyl acetate) to give the compound (3.7 g) as light yellow oil.

Compound 4

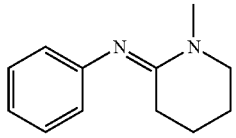

Compound 5

To a solution of 1-Benzyl-2-pyrrolidinone (8 mL, 50 mmol) in Toluene (130 mL) was added phosphorus (V) oxychloride (2.33 mL, 25 mmol) dropwise at 0° C. The reaction was stirred at 0° C. for 2 hours. 4-Butylaniline (3.95 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was purified by flash-column chromatography (triethylamine 3% in ethyl acetate) to give the compound (7.5 g) as yellow oil.

Compound 5

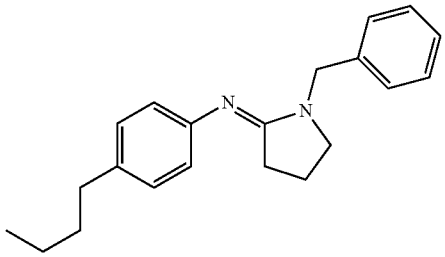

Compound 6

To a solution of 1-methyl-2-pyrrolidinone (4.82 mL, 50 mmol) in Toluene (150 mL) was added phosphorus (V) oxychloride (2.33 mL, 25 mmol) dropwise at 0° C. The reaction was stirred at 0° C. for 2 hours. 4-Butylaniline (3.95 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product NMR showed the compound was clean enough, not necessary for the further purification. The compound was obtained (5.9 g, 100% yield) as brown oil.

Compound 6

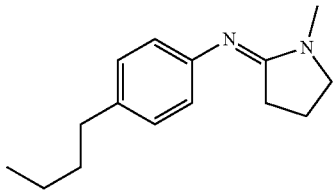

Compound 7

To a solution of of N-methylcaprolactam (6.4 mL, 50 mmol) in Toluene (130 mL) was added phosphorus (V) oxychloride (2.33 mL, 25 mmol) dropwise at 0° C. The reaction was stirred at 0° C. for 2 hours. 4-Butylaniline (3.95 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was purified by flash-column chromatography (triethylamine 3% in ethyl acetate) to give the compound (4.2 g) as yellow oil.

Compound 7

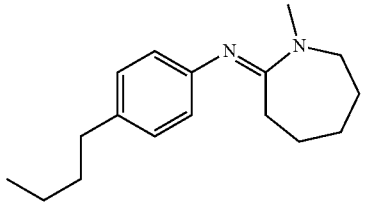

Compound 8

To a solution of valerolactam (4.96 g, 50 mmol) in Toluene (150 mL) was added phosphorus (V) oxychloride (2.33 mL, 25 mmol) dropwise at 0° C. The reaction was stirred at 0° C. for 2 hours. 4-Butylaniline (3.95 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product NMR showed the compound was clean enough, not necessary for the further purification. The compound was obtained (5.0 g, 86% yield) as brown solid.

Compound 8

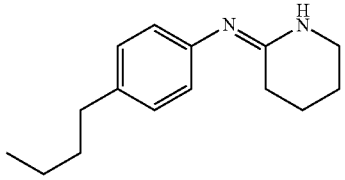

Compound 9

To a solution of N-methyl-2-piperidone (5.71 mL, 50 mmol) in Toluene (150 mL) was added phosphorus (V) oxychloride (2.33 mL, 25 mmol) dropwise at 0° C. The reaction was stirred at 0° C. for 2 hours. 4-Butylaniline (3.95 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product NMR showed the compound was clean enough, not necessary for the further purification. The compound was obtained (6.8 g, 100% yield) as brown oil.

Compound 9

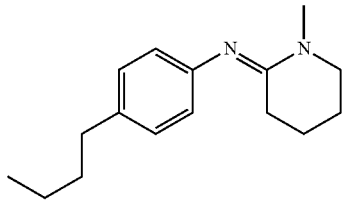

Compound 10

To a solution of ϵ-caprolactam (5.6 g, 50 mmol) in Toluene (150 mL) was added phosphorus (V) oxychloride (2.33 mL, 25 mmol) dropwise at 0° C. The reaction was stirred at 0° C. for 2 hours. 4-Butylaniline (3.95 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was purified by flash-column chromatography (triethylamine 3% in ethyl acetate) to give the compound (4.6 g) as yellow solid.

Compound 10

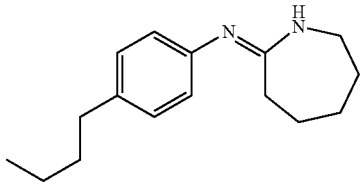

Compound 11

To a solution of of 1,3-dimethyl-3,4,5,6-tetrahydro-2(1H)-pyrimidinone (6.40 g, 50 mmol) in Toluene (130 mL) was added phosphorus (V) oxychloride (2.33 mL, 25 mmol) dropwise at 0° C. The reaction was stirred at 0° C. for 2 hours. 4-Butylaniline (3.95 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was purified by flash-column chromatography (triethylamine 3% in ethyl acetate) to give the compound (4.2 g) as brown oil.

Compound 11

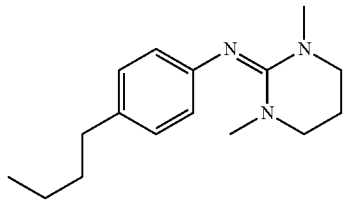

Compound 12

To a solution of of 1,3-dimethyl-2-imidazolidinone (5.70 g, 50 mmol) in Toluene (130 mL) was added phosphorus (V) oxychloride (2.33 mL, 25 mmol) dropwise at 0° C. The reaction was stirred at 0° C. for 2 hours. 4-Butylaniline (3.95 mL, 25 mmol) was added to the solution in one portion. The reaction mixture was refluxed under stirring for 4 hours. The organic layer was removed and the residue was dissolved in water (150 mL). NaOH (2N) was added to adjust the solution PH to 10. Ethyl acetate was added for the extraction. The organic layer was collected, dried and removed. The crude product was purified by flash-column chromatography (triethylamine 3% in ethyl acetate) to give the compound (3.6 g) as brown oil.

Compound 12

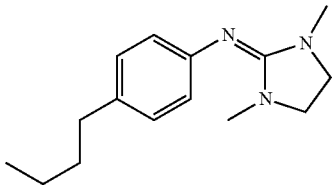

Compound 13

To a solution of triethyloxonium tetrafluoroborate (5.7 g, 30 mmol) in dichloromethane (8 mL) was added 1-methyl-2-pyrrolidinone (2.86 mL, 30 mmol) in dichloromethane (8 mL) at room temperature. The resulting solution was stirred at room temperature for 4 hours. Cyclohexylamine (2.86 mL, 25 mmol) was added to the solution. The reaction mixture was stirred at room temperature overnight. The reaction mixture was washed with NaOH (1N, 15 mL) twice. Then the organic layer was washed with brine, dried ($Na_2SO_4$) and concentrated. The crude compound NMR is clean enough, that no further purification is needed. The compound was obtained (4.3 g, 95% yield) as a yellow solid.

Compound 13

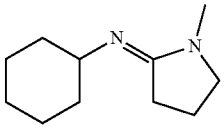

Compound 14

To a solution of triethyloxonium tetrafluoroborate (5.7 g, 30 mmol) in dichloromethane (8 mL) was added N-methyl-2-piperidone (3.43 mL, 30 mmol) in dichloromethane (8 mL) at room temperature. The resulting solution was stirred at room temperature for 4 hours. Cyclohexylamine (2.86 mL, 25 mmol) was added to the solution. The reaction mixture was stirred at room temperature overnight. The reaction mixture was washed with NaOH (1N, 15 mL) twice. Then the organic layer was washed with brine, dried ($Na_2SO_4$) and concentrated. The crude compound NMR is pretty clean, no further purification is needed. The compound was obtained (4.9 g, 98% yield) as a yellow solid.

Compound 14

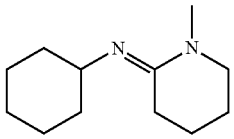

Volot Test

Compounds 1-4 are subjected to Viscosity On-Line Oxidation Test (VOLOT). In the VOLOT test, 3 gram sample of test oil at 130° C. was blown with air at a flow rate of 16.7±0.1 mL per minute. A viscosity reading was automatically taken every 600 seconds (10 minutes). The test is over when the sample oil increase 20% of the viscosity.

The following Comparative Examples and Test Examples were prepared.

Comparative Example A contains 0.5 wt % of diphenylamine (DPA) in Gr II base oil.

Comparative Example B contains 0.8 wt % of diphenylamine (DPA) in Gr II base oil.

Comparative Example C contains 1.0 wt % Compound 5 in Gr II base oil.

Test Example 1 contains 0.5 wt % of Compound 1 with 0.5 wt % DPA in Gr II base oil.

Test Example 2 contains 0.5 wt % of Compound 2 with 0.5 wt % DPA in Gr II base oil.

Test Example 3 contains 0.5 wt % of Compound 3 with 0.5 wt % DPA in Gr II base oil.

Test Example 4 contains 0.5 wt % of Compound 4 with 0.5 wt % DPA in Gr II base oil.

Test Example 5 contains 0.5 wt % of Compound 5 with 0.5 wt % DPA in Gr II base oil Comparative Examples A, B, and C, and Test Examples 1 to 5 were evaluated in the VOLOT test. The results are shown in Table 1.

TABLE 1

| Components (wt %) | Comp. Ex. A | Test Ex. 1 | Test Ex. 2 | Test Ex. 3 | Test Ex. 4 | Comp. Ex. B | Comp. Ex. C | Test Ex. 5 |
|---|---|---|---|---|---|---|---|---|
| DPA | 0.5 | 0.5 | 0.5 | 0.5 | 0.5 | 0.8 | | 0.8 |
| Compound 1 | | 0.5 | | | | | | |
| Compound 2 | | | 0.5 | | | | | |
| Compound 3 | | | | 0.5 | | | | |
| Compound 4 | | | | | 0.5 | | | |
| Compound 5 | | | | | | | 1.0 | 1.0 |
| Results (hr) | 22 | 250 | 250 | 250 | 250 | 37.85 | 16 | 248 |

The oxidation of the base oil results in a viscosity increase of the oil. The VOLOT test reports the time duration that the viscosity of the oil increased to 20%, and the test will stop after 250 hrs. Therefore, the longer the tests continue, the more superior the oxidation inhibition performance. Test Examples 1-4 showed 250 hrs, which is the test stopping point, meaning that it needs at least 250 hrs for Examples 1-4 to have viscosity increase to 20% of their original viscosity. After 250 hours, Test Examples 1-4 were still continuing, compared to 22 hour stop time for the Comparative Example A, thereby showing surprisingly superior oxidation inhibition performance and outstanding synergistic effects of the combination of the amidine compounds with DPA. Additionally, Test Example 5 also shows outstanding synergistic antioxidant performance over Comparative Examples B and C at higher concentrations of both the amidine compound and DPA.

Lube Oil Oxidator Test 1

A 25 gram sample was weighted into a special glass oxidator cell. A catalyst was added, followed by inserting a glass stirrer. The cell was then sealed and placed in an oil bath maintained at 340° F. and connected to the oxygen supply. One liter of oxygen was fed into the cell while the stirrer agitated the oil sample. The test was run until 1 liter of oxygen was consumed by the same and the total time, in hours, of the sample run was reported. The test result indicates the oil's resistance to oxygen uptaken. The better the antioxidancy of the oil, the longer it takes for 1 liter of oxygen to be consumed. It shows the effectiveness of the antioxidants in inhibiting the oxidation of the oil.

TABLE 2

| Baseline Formulation | |
|---|---|
| Components | Treat Rate |
| Borated succinimide | 0.6 wt % |
| Succinimide | 3.2 wt % |
| Phenate | 10 mM |
| Sulfonate | 40 mM |
| Primary ZnDTP | 8.5 mM |
| Secondary ZnDTP | 4 mM |
| Friction modifier | 0.3 wt % |
| Foam inhibitor | 5.0 ppm |
| Pour point depressant | 0.4 wt % |
| VII | 7.3 wt % |

The following lubricating oil compositions were prepared.

Comparative Example D is a lubricating oil composition prepared by adding 0.8 wt % DPA to Baseline Formulation I in Gr II base oil.

Comparative Example E is a lubricating oil composition prepared by adding 1.0 wt % Compound 3 to Baseline Formulation I in Gr II base oil.

Comparative Example F is a lubricating oil composition prepared by adding 1.0 wt % Compound 5 to Baseline Formulation I in Gr II base oil.

Comparative Example G is a lubricating oil composition prepared by adding 1.0 wt % Compound 11 to Baseline Formulation I in Gr II base oil.

Comparative Example H is a lubricating oil composition prepared by adding 1.0 wt % Compound 13 and 0.8% DPA to Base Formulation I in Gr II base oil.

Comparative Example I is a lubricating oil composition prepared by adding 1.0 wt % Compound 14 and 0.8% DPA to Base Formulation I in Gr II base oil.

Test Example 6 is a lubricating oil composition prepared by adding 1.0 wt % Compound 3 and 0.8% DPA to Base Formulation I in Gr II base oil.

Test Example 7 is a lubricating oil composition prepared by adding 1.0 wt % Compound 4 and 0.8% DPA to Base Formulation I in Gr II base oil.

Test Example 8 is a lubricating oil composition prepared by adding 1.0 wt % Compound 5 and 0.8% DPA to Base Formulation I in Gr II base oil.

Test Example 9 is a lubricating oil composition prepared by adding 1.0 wt % Compound 6 and 0.8% DPA to Base Formulation I in Gr II base oil.

Test Example 10 is a lubricating oil composition prepared by adding 1.0 wt % Compound 7 and 0.8% DPA to Base Formulation I in Gr II base oil.

Test Example 11 is a lubricating oil composition prepared by adding 1.0 wt % Compound 8 and 0.8% DPA to Base Formulation I in Gr II base oil.

Test Example 12 is a lubricating oil composition prepared by adding 1.0 wt % Compound 11 and 0.8% DPA to Base Formulation I in Gr II base oil.

Test Example 13 is a lubricating oil composition prepared by adding 1.0 wt % Compound 12 and 0.8% DPA to Base Formulation I in Gr II base oil.

Comparative Examples D to I and Test Examples 6 to 13 were evaluated using the Lube Oil Oxidator Test. The results are shown in Table 3.

TABLE 3

| Lube oil Oxidator Test | | | | | | | | |
|---|---|---|---|---|---|---|---|---|
| Components wt % | Comparative Example D | Test Example 6 | Comparative Example E | Test Example 7 | Test Example 8 | Comparative Example F | Test Example 9 | Test Example 10 |
| DPA | 0.8 | 0.8 | — | 0.8 | 0.8 | — | 0.8 | 0.8 |
| Compound 3 | | 10 | 1.0 | | | | | |
| Compound 4 | | | | 1.0 | | | | |
| Compound 5 | | | | | 1.0 | 1.0 | | |
| Compound 6 | | | | | | | 1.0 | |
| Compound 7 | | | | | | | | 1.0 |
| Compound 8 | | | | | | | | |
| Compound 11 | | | | | | | | |
| Compound 12 | | | | | | | | |
| Compound 13 | | | | | | | | |
| Compound 14 | | | | | | | | |
| Results (hr) | 24.6/25 | 32.2/41 | 15 | 33.2 | 40.6/44 | 30 | 28.7 | 34 |

TABLE 3-continued

| Lube oil Oxidator Test | | | | | | | |
|---|---|---|---|---|---|---|---|
| Components wt % | Test Example 11 | Test Example 12 | Comparative Example G | Test Example 13 | Comparative Example H | Comparative Example I | Comparative Example J |
| DPA | 0.8 | 0.8 | — | 0.8 | — | 0.8 | 0.8 |
| Compound 3 | | | | | | | |
| Compound 4 | | | | | | | |
| Compound 5 | | | | | | | |
| Compound 6 | | | | | | | |
| Compound 7 | | | | | | | |
| Compound 8 | 1.0 | | | | | | |
| Compound 11 | | 1.0 | 1.0 | | | | |
| Compound 12 | | | | 1.0 | 1.0 | | |
| Compound 13 | | | | | | 1.0 | |
| Compound 14 | | | | | | | 1.0 |
| Results (hr) | 28.5 | 29 | 13 | 28 | 8 | 15.9 | 12.8 |

A combination of both DPA and Compound 3, 5, 11, 12 in Test Examples 6, 8, 12, 13 respectively, show surprisingly superior anti-oxidation performance over Comparative Examples D, E, F, G, and H, which contain either DPA or Compounds 3, 5, 11, 12 alone. This is indicative of the synergistic effect of the amidine compounds in combination with diphenylamine.

Comparative Examples I and J do not show good anti-oxidation performance due to the fact that Compound 13 and 14 are aliphatic amidines instead of aromatic amidines as in the Test Examples. It is more related with aromatic ring conjugation with cation (positive charge). Once nitrogen accepts a proton to form a cation, the aromatic ring $\pi$ bond system can stabilize the cation better than the cyclized six member ring.

Test Example 17 is a lubricating oil composition prepared by adding 1.0 wt % Compound 8, 0.8% DPA and 0.4 wt % molybdenum succinimide to Base Formulation I in Gr II base oil.

Test Example 18 is a lubricating oil composition prepared by adding 1.0 wt % Compound 9, 0.8% DPA and 0.4 wt % molybdenum succinimide to Base Formulation I in Gr II base oil.

Test Example 19 is a lubricating oil composition prepared by adding 1.0 wt % Compound 10, 0.8% DPA and 0.4 wt % molybdenum succinimide (Moly) to Base Formulation I in Gr II base oil.

Comparative Example M and Test Examples 14 to 19 were evaluated in the Lube Oil Oxidator Test. The results are shown in Table 4.

TABLE 4

| Components wt % | Comp. Example M | Test Example 14 | Test Example 15 | Test Example 16 | Test Example 17 | Test Example 18 | Test Example 19 |
|---|---|---|---|---|---|---|---|
| DPA | 0.8 | 0.8 | 0.8 | 0.8 | 0.8 | 0.8 | 0.8 |
| Moly | 0.4 | 0.4 | 0.4 | 0.4 | 0.4 | 0.4 | 0.4 |
| Compound 5 | | 1.0 | | | | | |
| Compound 6 | | | 1.0 | | | | |
| Compound 7 | | | | 1.0 | | | |
| Compound 8 | | | | | 1.0 | | |
| Compound 9 | | | | | | 1.0 | |
| Compound 10 | | | | | | | 1.0 |
| Results (hr) | 40 | 56.8 | 57 | 59.6 | 57 | 66.3 | 67.8 |

Lube Oil Oxidator Test 2

Comparative Example M is a lubricating oil composition prepared by adding 0.8 wt % DPA and 0.4 wt % molybdenum succinimide (OLOA 17505) to Baseline Formulation I in Gr II base oil.

Test Example 14 is a lubricating oil composition prepared by adding 1.0 wt % Compound 5, 0.8% DPA and 0.4 wt % molybdenum succinimide to Base Formulation I in Gr II base oil.

Test Example 15 is a lubricating oil composition prepared by adding 1.0 wt % Compound 6, 0.8% DPA and 0.4 wt % molybdenum succinimide to Base Formulation I in Gr II base oil.

Test Example 16 is a lubricating oil composition prepared by adding 1.0 wt % Compound 7, 0.8% DPA and 0.4 wt % molybdenum succinimide to Base Formulation I in Gr II base oil.

Test Examples 5 to 10 show superior surprisingly performance on the Oxidator test over Comparative Example M. This is indicative of the synergistic effect of the amidine compounds when combined with both a diphenylamine and a moly succinimide antioxidant.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising:

(a) a major amount of a lubricating oil, (b) a diarylamine antioxidant, and (c) an amidine compound of Formula (I), Formula (I)

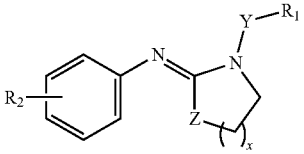

wherein $R_1$ is hydrogen, an alkyl or an aromatic group containing 1-30 carbon atoms; x is from 1 to 5; Y is an optional linking alkyl group; Z is carbon or nitrogen; and $R_2$ is hydrogen or alkyl groups containing 1-30 carbon atoms.

2. The lubricating oil composition of claim 1, wherein the diarylamine antioxidant is selected from the group comprising diphenylamine, phenyl-α-naphthylamine, and alkylated diarylamines.

3. The lubricating oil composition of claim 2, wherein the diarylamine antioxidant is diphenylamine.

4. The lubricating oil composition of claim 1, wherein the concentration of the diarylamine antioxidant in the lubricating oil composition is at least about 0.01 wt. %.

5. The lubricating oil composition of claim 1, wherein the concentration of the diarylamine antioxidant in the lubricating oil composition is 0.01 to 10 wt. %.

6. The lubricating oil composition of claim 1, wherein the concentration of the diarylamine antioxidant in the lubricating oil composition is 0.2 to 10 wt. %.

7. The lubricating oil composition of claim 1, wherein the concentration of the diarylamine antioxidant in the lubricating oil composition is 0.1 to 5 wt. %.

8. The lubricating oil composition of claim 1, wherein the concentration of the amidine compound in the lubricating oil composition is from greater than 0.5 to 5 wt. %.

9. The lubricating oil composition of claim 1, wherein the concentration of the amidine compound in the lubricating oil composition from greater than 0.5 to 2 wt. %.

10. A lubricating oil composition in claim 1 further comprises a molybdenum-containing antioxidant.

11. A lubricating oil composition in claim 10, wherein the molybdenum-containing antioxidant is a molybdenum succinimide.

12. A method for lubricating an engine comprising lubricating the engine with a lubricating oil composition comprising:

(a) a major amount of a lubricating oil, (b) a diarylamine antioxidant, and (c) an amidine compound of Formula (I), Formula (I)

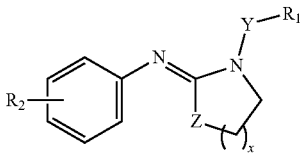

wherein $R_1$ is hydrogen, an alkyl or an aromatic group containing 1-30 carbon atoms; x is from 1 to 5; Y is an optional linking alkyl group; Z is carbon or nitrogen; and $R_2$ is hydrogen or alkyl groups containing 1-30 carbon atoms.

13. The method of claim 12 wherein the concentration of the diarylamine antioxidant in the lubricating oil composition is 0.01 to 10 wt. %.

14. The method of claim 12 wherein the concentration of the amidine compound in the lubricating oil composition is from greater than 0.5 to 5 wt. %.

15. The method of claim 12 wherein the lubricating oil composition further comprises a molybdenum-containing antioxidant.

16. The method of claim 15 wherein the molybdenum-containing antioxidant is a molybdenum succinimide.

* * * * *